US006869162B2

(12) United States Patent
Maher

(10) Patent No.: US 6,869,162 B2
(45) Date of Patent: Mar. 22, 2005

(54) PRINTING DEVICE AND METHOD FOR SERVICING SAME

(75) Inventor: Edward P. Maher, Oceanside, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 92 days.

(21) Appl. No.: 10/401,189

(22) Filed: Mar. 27, 2003

(65) Prior Publication Data

US 2004/0189736 A1 Sep. 30, 2004

(51) Int. Cl.[7] ..... B41J 2/165

(52) U.S. Cl. ..... 347/29; 347/22; 347/30; 347/32; 347/33

(58) Field of Search ..... 347/22, 24, 29–36

(56) References Cited

U.S. PATENT DOCUMENTS 5,057,854 A 10/1991 Pond et al.
5,094,554 A 3/1992 Hurd et al.
5,160,945 A 11/1992 Drake
5,192,959 A 3/1993 Drake et al.
5,206,666 A 4/1993 Watanabe et al.
5,257,043 A 10/1993 Kneezel
5,257,044 A 10/1993 Carlotta et al.
5,270,738 A 12/1993 Takahashi et al.
5,280,308 A 1/1994 Takahashi et al.
5,367,326 A 11/1994 Pond et al.
5,428,375 A 6/1995 Simon et al.
5,534,897 A 7/1996 Anderson et al.
5,572,244 A 11/1996 Drake et al.
5,587,730 A 12/1996 Karz
5,610,640 A 3/1997 Anderson et al.
5,710,582 A 1/1998 Hawkins et al.
5,757,387 A 5/1998 Manduley
5,784,077 A 7/1998 Silverbrook
5,838,343 A 11/1998 Chapin et al.
5,889,535 A 3/1999 Jackson et al.
5,933,163 A 8/1999 Koizumi et al.
6,089,693 A 7/2000 Drake et al.
6,155,669 A 12/2000 Donahue et al.
6,172,691 B1 1/2001 Belon et al.
6,183,059 B1 2/2001 Muhl et al.
6,224,187 B1 5/2001 Inten et al.
6,293,648 B1 * 9/2001 Anderson ..... 347/29
6,310,640 B1 10/2001 Askeland
6,325,488 B1 12/2001 Beerling et al.
6,350,011 B1 2/2002 Karlinski
6,371,672 B1 4/2002 Pirie et al.
6,375,296 B1 4/2002 McGarry et al.
6,382,766 B1 5/2002 Park
6,382,767 B1 5/2002 Greive
6,402,288 B2 6/2002 Rhodes et al.
6,402,290 B1 6/2002 Johnson et al.
6,409,306 B1 6/2002 Shiida
6,422,679 B1 7/2002 Aldrich
6,435,640 B1 8/2002 Yamaguchi
6,457,800 B1 10/2002 Bohm et al.
6,471,331 B1 10/2002 Silverbrook et al.
6,585,347 B1 * 7/2003 Johnson et al. ..... 347/22
2001/0038401 A1 11/2001 Kawase et al.
2002/0018097 A1 2/2002 Kitahara et al.
2002/0024557 A1 2/2002 Matsumoto et al.
2002/0044168 A1 4/2002 Hashi et al.
2002/0126176 A1 9/2002 Nishi et al.
2002/0167563 A1 11/2002 Sawyer et al.
2002/0171708 A1 11/2002 Watanabe et al.

* cited by examiner

*Primary Examiner*—Shih-Wen Hsieh

(57) ABSTRACT

In accordance with one embodiment, a printing device includes one or more print cartridges configured to remain stationary in a first position over a media path during printing and configured to be serviced while in a second position outside an area above the media path. The printing device further includes a service station configured to service the one or more print cartridges; and, a motor assembly configured to move the one or more print cartridges from the first position to the second position.

29 Claims, 9 Drawing Sheets

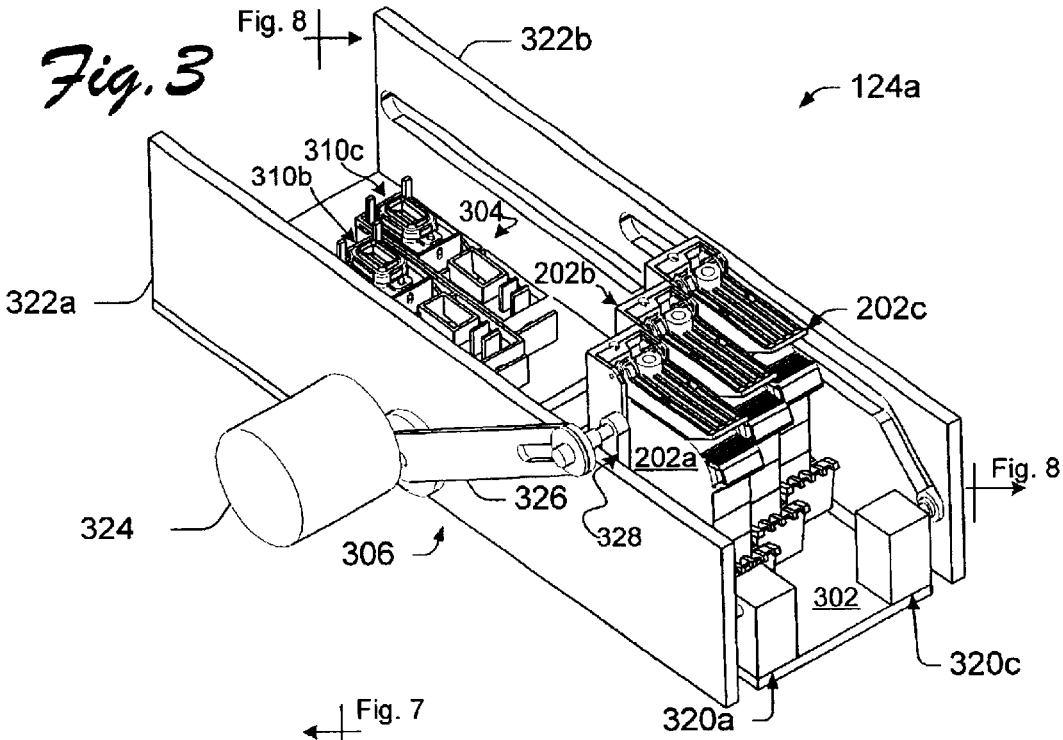
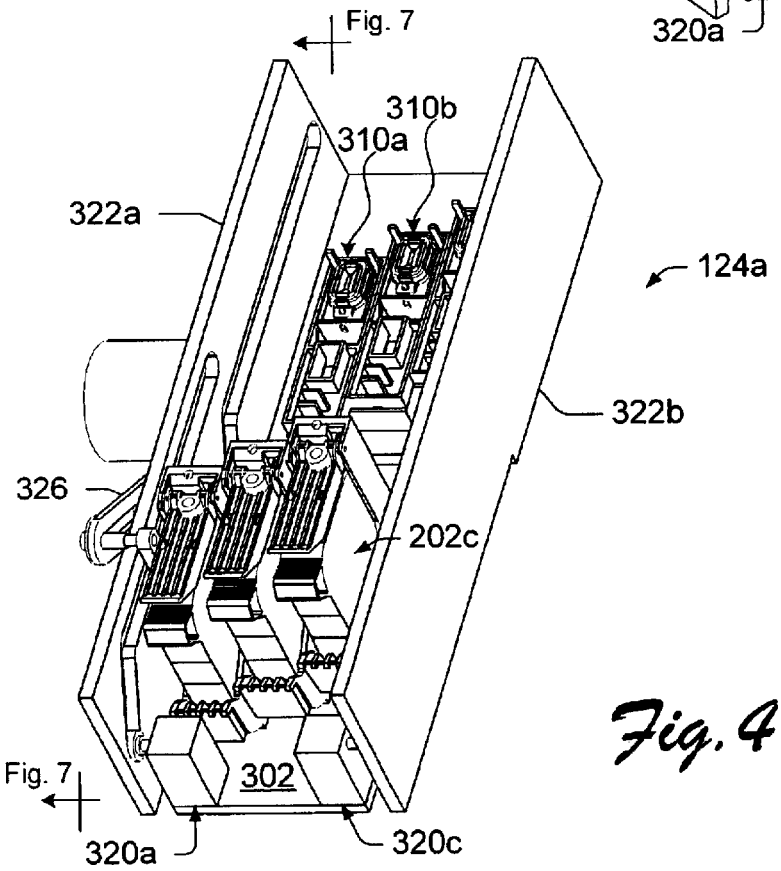
Fig. 4

Fig. 5
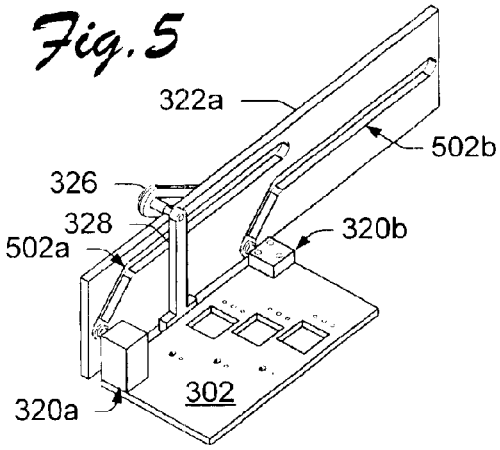
Fig. 6
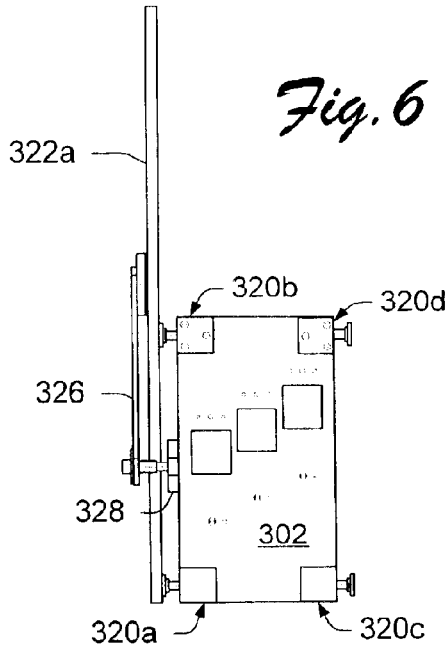
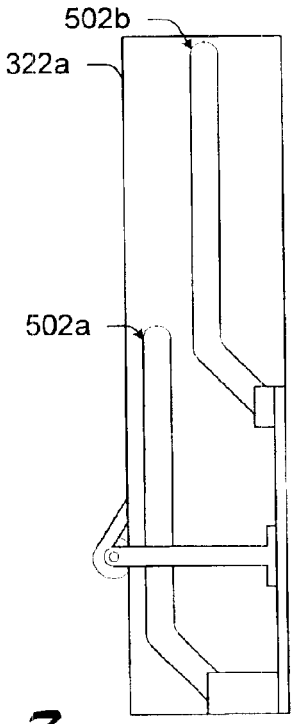
Fig. 7
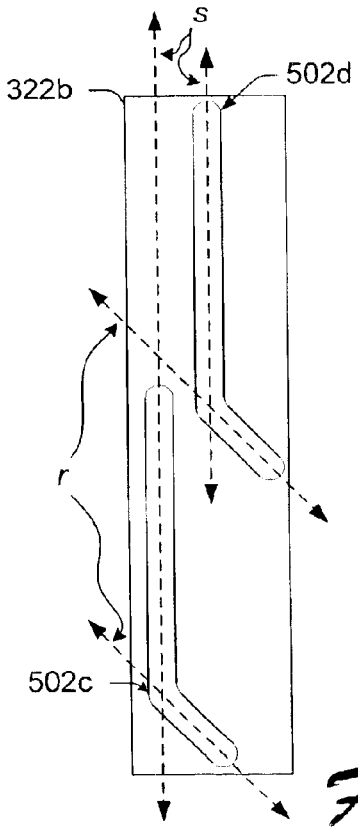
Fig. 8

PRINTING DEVICE AND METHOD FOR SERVICING SAME

BACKGROUND

Ink jet printing systems typically operate by applying ink from one or more print cartridges onto a print media such as paper. The print cartridges contain multiple nozzles that may be controlled to selectively eject ink. Servicing the print cartridges between print jobs, or periodically during print jobs, often allows such printing systems to function more reliably and to produce higher quality images. In some applications, however, such as those utilizing print cartridges that remain in a fixed position relative to a web of print media moving past the print cartridges during printing, servicing the print cartridges can be difficult. For these and other reasons, there is a need for the present invention.

BRIEF DESCRIPTION OF THE DRAWINGS

FIG. 3 shows a perspective view of a portion of an exemplary print unit in accordance with one embodiment.

FIG. 4 shows a different perspective view of the exemplary print unit shown in FIG. 3.

FIG. 5 shows a perspective view of a portion of the exemplary print unit shown in FIGS. 3–4

FIG. 6 shows a top view of the portion of the exemplary print unit shown in FIG. 5.

FIG. 7 shows an elevational view of the exemplary side plate shown in FIG. 3.

FIG. 8 shows an elevational view of the exemplary side plate shown in FIG. 3.

DETAILED DESCRIPTION OF THE PREFERRED EMBODIMENTS

Overview

In accordance with various embodiments, a printing device is disclosed. In one embodiment, the printing device has a print unit that can comprise multiple print cartridges arranged in an offset array to create a desired image on print media. Such print cartridges are less likely to malfunction and are better able to produce high quality images by receiving servicing from time to time. In some embodiments, such servicing provides one or more of the functions of wiping, receiving ink ("spitting"), and capping.

In one embodiment the print cartridges can be moved to a first position over a media path for image forming. The print cartridges can be moved to a second position for servicing. Various suitable configurations can be utilized. In some embodiments, the print cartridges are moved along a first direction, and then a second different direction for servicing. In one embodiment, the movement in both the first and second directions is achieved with a single motor.

Embodiments

Figure 1:
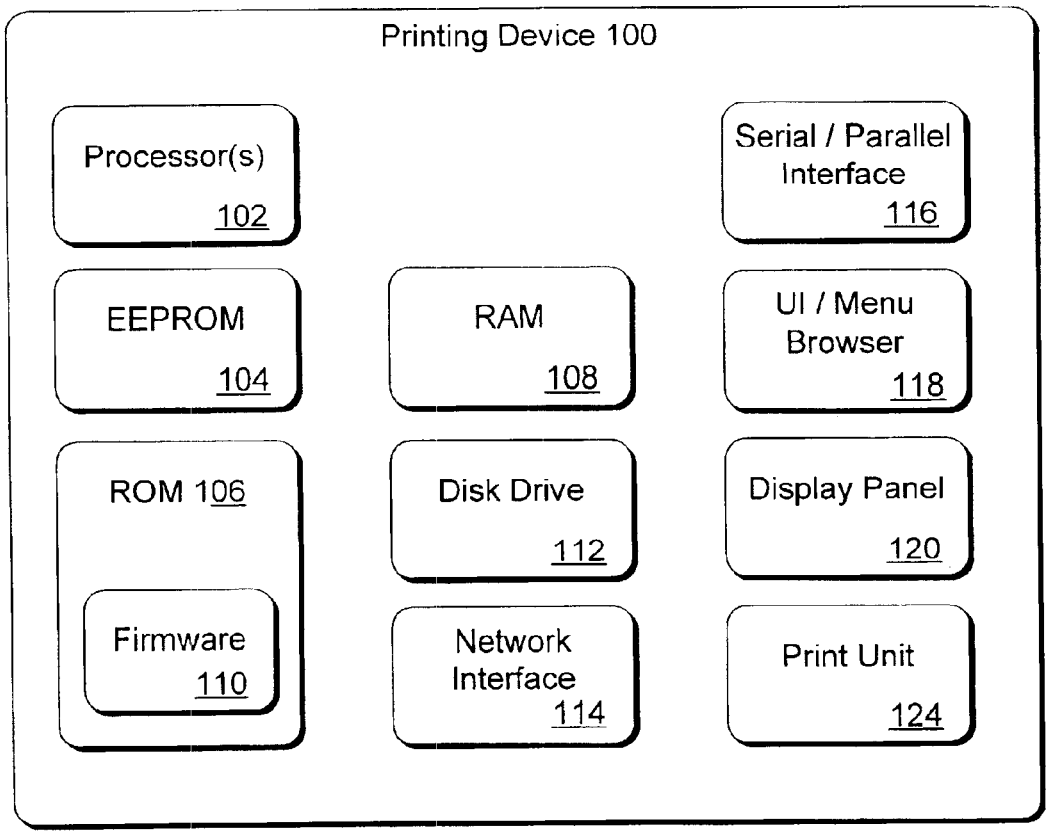
FIG. 1 shows a block diagram that illustrates various components of an exemplary printing device in accordance with one embodiment.

FIG. 1 illustrates various components of an exemplary printing device 100. Printing device 100 may include one or more controllers that are embodied as one or more processors 102 to control various printing operations, such as media handling, servicing, and ink ejection.

Printing device 100 may have an electrically erasable programmable read-only memory (EEPROM) 104, ROM 106 (non-erasable), and a random access memory (RAM) 108. Although printing device 100 is illustrated as having an EEPROM 104 and ROM 106, a particular printing device may only include one of the memory components. Additionally, although not shown, a system bus may connect the various components within the printing device 100.

The printing device 100 may also have a firmware component 110 that is implemented as a permanent memory module stored on ROM 106. The firmware 110 is programmed and tested like software, and is distributed with the printing device 100. The firmware 110 may be implemented to coordinate operations of the hardware within printing device 100 and contains programming constructs used to implement such operations.

Processor(s) 102 process various instructions to control the operation of the printing device 100 and to communicate with other electronic and computing devices. The memory components, EEPROM 104, ROM 106, and RAM 108, store various information and/or data such as configuration information, fonts, templates, data being printed, and menu structure information. Although not shown, a particular printing device may also include a flash memory device in place of or in addition to EEPROM 104 and ROM 106.

Printing device 100 may also include a disk drive 112, a network interface 114, and a serial/parallel interface 116, which can comprise any type of suitable interface. Examples of serial/parallel interface 116 can comprise a USB, and/or an IEEE 1394 compliant interface, among others. Disk drive 112 provides additional storage for data being printed or other information maintained by the printing device 100. Although printing device 100 is illustrated having both RAM 108 and a disk drive 112, a particular printing device may include either RAM 108 or disk drive 112, depending on the storage needs of the printer. For example, some printing devices may include a small amount of RAM 108 and no disk drive 112, thereby reducing the manufacturing cost of the printing device.

Network interface 114 provides a connection between printing device 100 and a data communication network. The network interface 114 allows devices coupled to a common data communication network to send print jobs, menu data, and other information to printing device 100 via the network. Similarly, serial/parallel interface 116 provides a data communication path directly between printing device 100 and another electronic or computing device. Although printing device 100 is illustrated having a network interface 114 and serial/parallel interface 116, a particular printing device may only include one such interface component.

Printing device 100 may also include a user interface and menu browser 118, and a display panel 120. The user interface and menu browser 118 allow a user of the printing device 100 to navigate the printing device's menu structure. User interface 118 may be implemented as indicators or a series of buttons, switches, or other selectable controls that are manipulated by a user of the printing device. Display panel 120 is a graphical display that provides information regarding the status of the printing device 100 and the current options available to a user through the menu structure.

Printing device 100 also includes a print unit 124 that includes mechanisms arranged to selectively apply ink (e.g., liquid ink) to a print media such as paper, plastic, fabric, or the like in accordance with print data corresponding to a print job. The function of print unit 124 can be controlled by a controller such as processor 102, which can execute instructions stored for such purposes.

Figure 2:
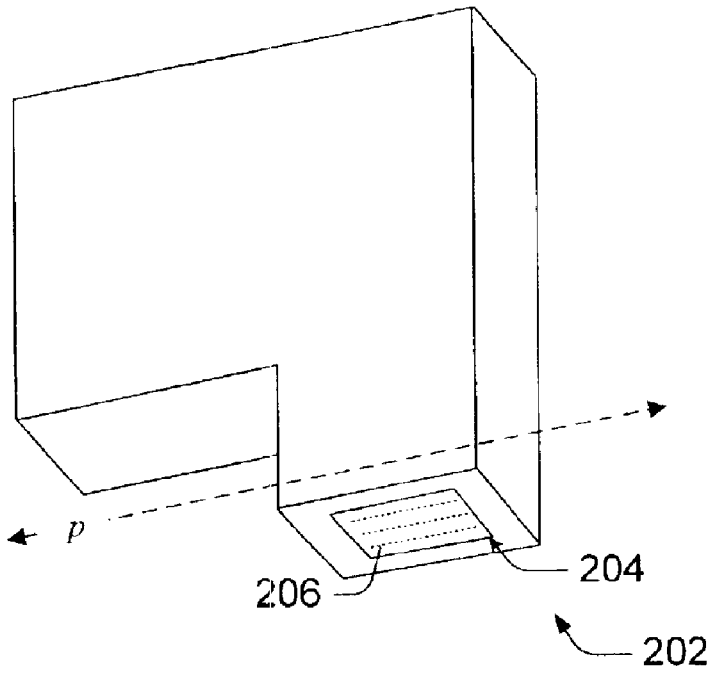
FIG. 2 shows an exemplary print cartridge in accordance with one embodiment.
Figure 2A:
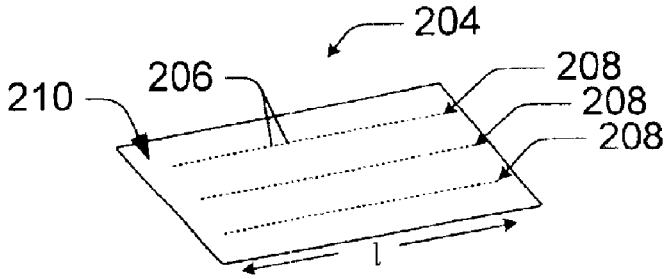
FIG. 2*a* shows an enlarged portion of the exemplary print cartridge shown in FIG. 2.

FIGS. 2–2*a* show portions of an exemplary print cartridge or "pen" 202. FIG. 2 shows a perspective view of print cartridge 202. The print cartridge has a generally planar print head 204 through which a plurality of firing nozzles 206 are arranged. Generally, the print head 204 defines a bottom surface of the print cartridge 202 and is disposed proximate the print media (e.g., FIG. 12) on which an image is intended to be printed.

The firing nozzles 206 are fired individually to deposit drops of ink onto the print media according to data that is received from the processor 102. As an example, the print head 204 might have firing nozzles 206 that number into the hundreds. A "firing" is the action of applying a firing pulse or driving voltage to an individual firing nozzle 206 to cause that firing nozzle to eject an ink drop or droplet.

As can more easily be seen in FIG. 2*a*, firing nozzles 206 may be arranged in one or more linear, or generally linear, nozzle array(s) 208. By way of example, and as shown in FIG. 2*a*, the firing nozzles 206 are arranged in three generally linear and generally parallel nozzle arrays 208 which can be seen on an exposed surface 210 of the print head 204.

Other suitable examples can have more of fewer nozzle arrays on a print head. An example that has a single nozzle array per print head in provided below. In the present embodiments, each of the three nozzle arrays 208 may be oriented generally parallel to a long axis of the print cartridge 202. For example, a long axis of the print cartridge may be seen in FIG. 2 and is designated as "p".

The nozzle arrays 208 have a length l that may represent a maximum print coverage swath attainable by print cartridge 202. An image that is wider than the print coverage swath may be formed in various ways such as moving either or both the print cartridge and the print media relative to the other, to allow adjacent swaths to be completed.

As will be described in more detail below, some embodiments can position one or more print cartridges 202 over a print media for printing in an orientation where a nozzle array 208 of the print cartridge is generally orthogonal to an axis along which print media is fed under the print cartridge. In some of these embodiments, the print cartridge(s) remains stationary during printing. Further, in some of these embodiments, several print cartridges can be staggered in an offset array over the print media to cover a greater percentage of the print media's width. In still further of these embodiments, the print cartridges can be moved to a position that is outside an area above the print media path for servicing.

FIGS. 3 and 4 show two different perspective views of a portion of an exemplary print unit 124*a*. In this embodiment, print unit 124*a* comprises three print cartridges 202*a*–*c*. Each of the print cartridges is positioned on a base plate 302. Print unit 124*a* also comprises a service station 304, and a motor assembly 306. In this embodiment, service station 304 comprises three cleaning units 310*a*–*c*. An exemplary cleaning unit will be described in more detail below in relation to FIGS. 9–10. In some embodiments, the various cleaning units can be connected to one another to form a service station. Other embodiments can connect the cleaning units to a common structure to form a service station.

In this embodiment, motor assembly 306 comprises four roller assemblies, two of which 320*a*, 320*c* are shown and two of which 320*b*, 320*d* are obstructed in this view, but can be seen in FIG. 6. In this embodiment, motor assembly 306 also comprises generally opposing first and second side plates 322*a*, 322*b*, and a motor 324. A crank arm 326 extends between motor 324 and lifter 328. In this embodiment the motor assembly's crank arm 326, lifter 328, and side plate 322*a* comprise a 4 bar linkage. Other suitable configurations will be recognized by the skilled artisan.

FIGS. 5–8 show views of portions of print unit 124*a* shown in FIGS. 3–4. FIGS. 5 and 6 show a perspective view and a top view respectively, while FIGS. 7 and 8 show side views. Some components are omitted for the purposes of illustration.

FIGS. 5–6 show side plate 322*a* and base plate 302. Crank arm 326 is coupled to lifter 328 which connects to base plate 302. Side plate 322*a* has tracks 502*a*, 502*b* formed therein along which roller assemblies 320*a*, 320*b* can be positioned. As shown in FIG. 5, tracks 502*a*, 502*b* have a depth which is less than the thickness of side plate 322*a*. Other suitable embodiments may have other track configurations. For example, in some embodiments, the track depth may pass all the way through the side plate. Each of the four roller assemblies 320*a*–*d* utilized in this embodiment can be seen attached to base plate 302 in FIG. 6.

FIGS. 7–8 show side views of side plates 322*a*, 322*b* respectively. Side plate 322*a* has tracks 502*a*, 502*b*, while side plate 322*b* has tracks 502*c*, 502*d*. The tracks can have a portion oriented along a first direction r and a portion oriented along a second different direction s, the purposes of which will become evident below.

Figure 9:
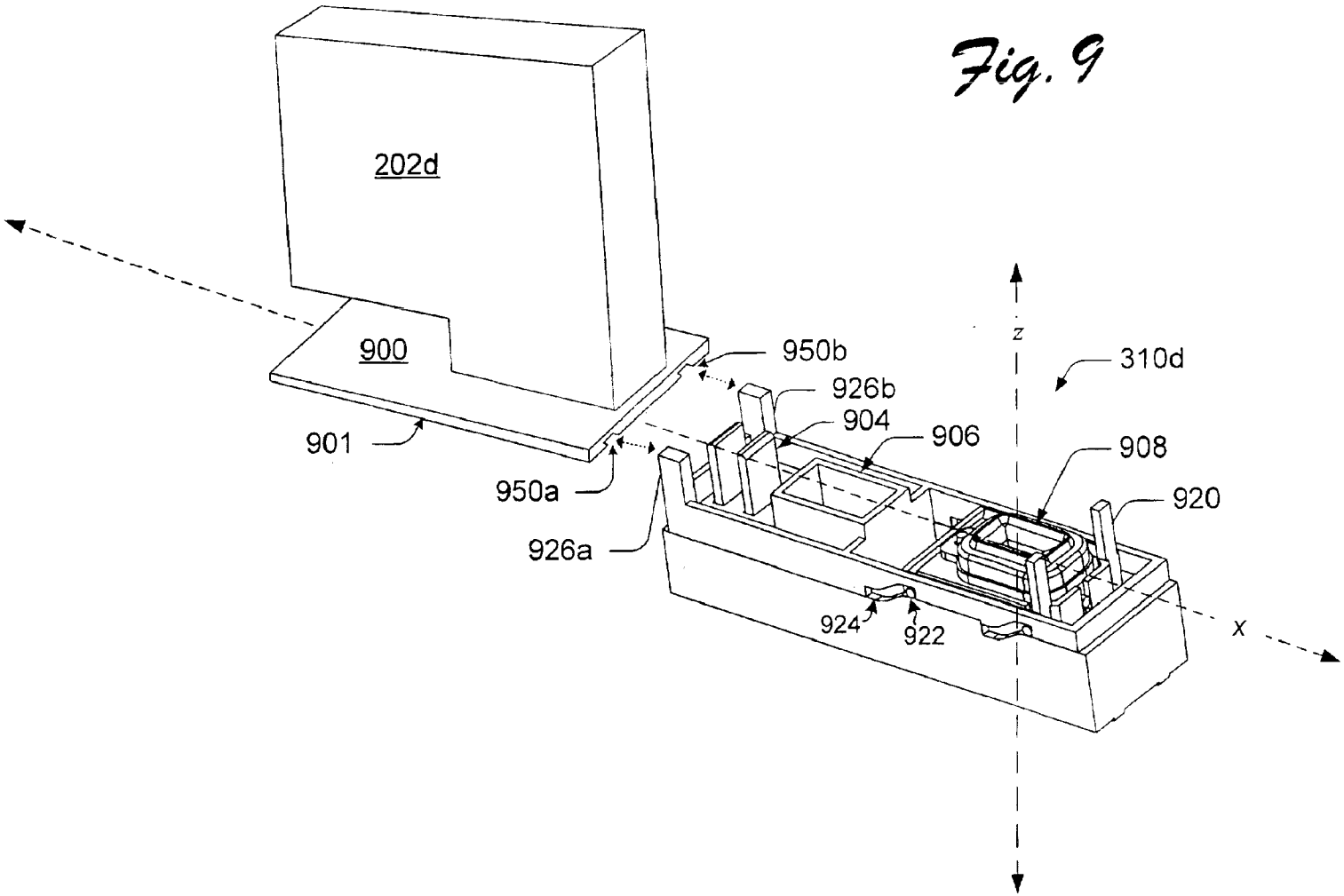
FIG. 9 shows a perspective view of portions of an exemplary print unit in accordance with one embodiment.
Figure 10:
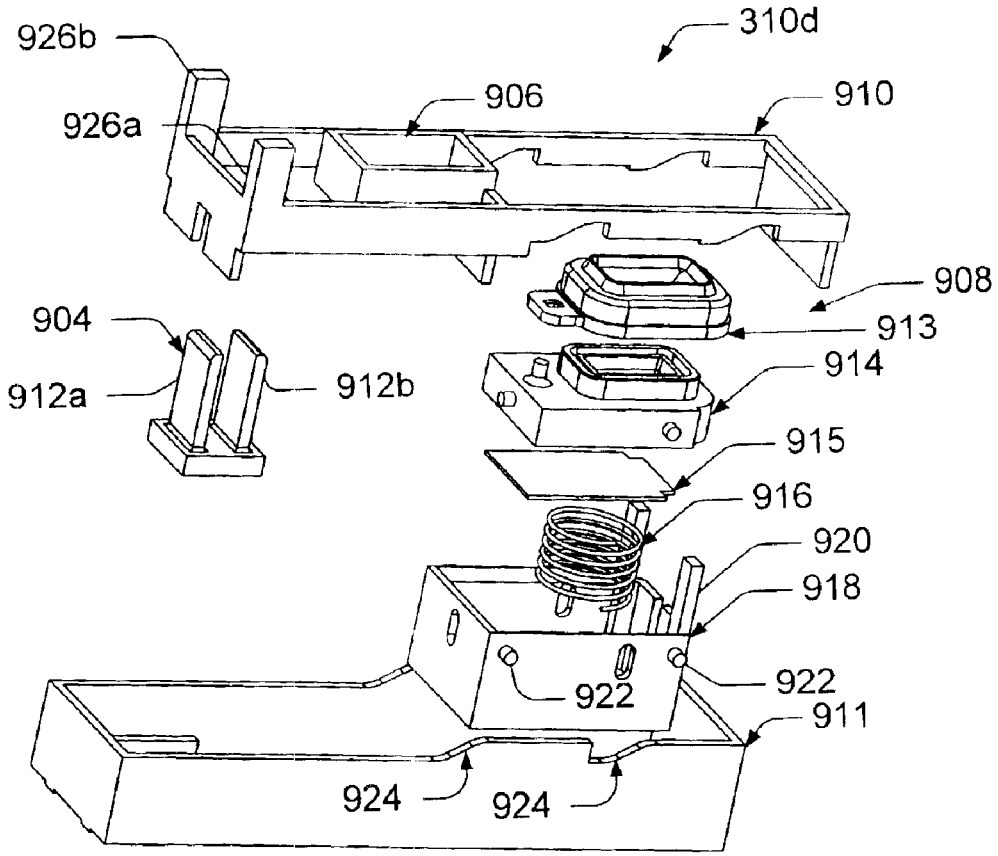
FIG. 10 shows an exploded view a portion of the exemplary print unit shown in FIG. 9.

FIGS. 9 and 10 show a portion of an exemplary print unit. FIG. 9 shows an exemplary cleaning unit 310*d* and an associated print cartridge 202*d* oriented to engage the cleaning unit for servicing. FIG. 10 shows an exploded view of cleaning unit 310*d*. The print cartridge and cleaning unit illustrated and described here represent but one configuration suitable for use with the described embodiments.

In this embodiment, print cartridge 202*d* is positioned on a print stall 900. A print stall is a structure or mechanism that holds a print cartridge in a desired orientation. A print cartridge positioned in a print stall may be referenced as a "print cartridge assembly" 901.

In this embodiment, cleaning unit 310*d* comprises a wiping component 904, a spitting (spit receiving) component or "spittoon" 906, and a capping component 908. In this embodiment, the wiping, spitting and capping components are arranged along a long axis x of the cleaning unit, though they can be arranged in other configurations and/or along other axes.

In this embodiment, cleaning unit 310*d* has a housing that comprises a top cover 910 and a bottom cover 911. Wiping component 904 comprises two wiper blades 912*a* and 912*b*, though other configurations can have more or fewer wiper blades.

Capping component 908 comprises a cap 913, a cap base 914, a cover 915, a spring 916, a pivot 918, and one or more engagement structure(s) 920 for engaging a print cartridge. Cam rods 922 which ride within associated cam slots 924 in the top and/or bottom cover ramp or "cam" the capping component 908 vertically as will be discussed in more detail below.

Alignment structures 926*a* and 926*b* may be utilized to aid alignment of a print cartridge relative to the cleaning unit. FIG. 9 shows one such example where the alignment structures (926*a* and 926*b*) may be received in corresponding slots 950*a* and 950*b* in a print stall 900 to provide improved alignment between print cartridge 202*d* and cleaning unit 310*d* for servicing the print cartridge. Other suitable embodiments may utilize alignment structures in various other configurations to improve alignment between a print cartridge and a cleaning unit for servicing of the print cartridge.

As will be discussed in more detail below, servicing of the print cartridge can involve bringing the print cartridge into contact with various cleaning or servicing components. In one embodiment, the print cartridge is brought into contact with the various servicing components in a sequential manner. According to one example embodiment, the print cartridge first undergoes wiping, then spitting, and, then capping.

Wiper blades 912*a* and 912*b* are configured to clean the exposed surface of the print head, an example of which is described in relation to FIG. 2*a*, and may be constructed of any suitable flexible material. Exemplary materials from which wiper blades 912*a* and 912*b* may be formed include, but are not limited to ethylene propylene diene monomer (EDPM) and silicon rubber among others.

Spitting component or spittoon 906 receives ink ejected or "spit" from a print cartridge's firing nozzle(s), described in relation to FIG. 2*a*. Ink received by spittoon 906 is not intended for printing, but instead to improve print quality by clearing the firing nozzle(s). Spitting component 906 may be any suitable shape, such as dish-shaped, and may be configured with an absorbent material lining its bottom to absorb ink. The spitting component 906, as shown in FIGS. 9 and 10, is molded into the top cover 910, though other suitable configurations will be recognized by the skilled artisan.

Spitting component 906 may have a capacity suitable for the intended use of the printing device in which it is employed. Printing devices that are configured for intermittent printing may utilize a larger capacity spitting component 906 than other printing devices that run more frequently.

Capping component 908 may function to seal the print cartridge's print head 204, described in relation to FIG. 2, to reduce desiccation of ink in the firing nozzles. Specifically, when a printing device is not printing, ink may dry in the firing nozzles and form a plug, which may block some or all of the firing nozzles causing a malfunction and/or resulting in degraded image quality of printed images. During periods when printing is not taking place, capping component 908 may seal around a portion of the print cartridge containing the print head to reduce air exchange around the firing nozzles and thereby slow the drying process.

Referring now to FIG. 10 which shows an exploded view of the cleaning unit 310*d*shown in FIG. 9. This view allows some of the elements comprising the cleaning unit to be seen in a little more detail.

Capping component 908 comprises cap 913 for sealing around a print cartridge. Cap 913 is positioned by a cap base 914. Cover 915 is positioned adjacent to the cap base 914 and is urged against the cap base by a spring 916 that is biased against, and held by, pivot 918.

In this embodiment, cover 915 is formed from Mylar which is advantageously easy to assemble, though other suitable materials may be used. Though not shown, a small channel in cap base 914 may allow air to escape during capping of print cartridge 202*d*. This configuration may advantageously reduce the chance of air being forced up into the firing nozzles of the print cartridge during capping.

Pivot 918 is further configured to allow cap 913 and cap base 914 to gimbal so that the cap may rotate slightly to align with the print head. Such a configuration provides desirable sealing characteristics between cap 913 and print cartridge 202*d*, especially if there is any misalignment of the print cartridge relative to the cap.

In some embodiments, print cartridge 202*d* and/or stall 900 may contact one or more engagement structures 920 of the capping component 908. The contact between print cartridge 202*d* and cleaning unit 310*d* may move capping component 908 in the x direction with the print cartridge. Such movement may also cause the capping component to move in a z direction (orthogonal to the x axis) by the action of cam rods 912*a*, 912*b* which ride within associated cam slots 914 defined by top and bottom covers 900 and 901, respectively.

The combination of cam slots 914 and cam rods 912*a*, 912*b* allows single axis movement of the print cartridge and/or cleaning unit 310*d* in the x direction to be converted into a two axis movement of the capping component 908 along the plane xz so that the capping component engages the print cartridge and seals the firing nozzles when the cartridge 202*d* and/or stall contacts engagement structures 920. When the print cartridge separates from the capping component 908 by reversing its path in cam slots 914, generally along the x axis, the capping component 908 may be returned to its initial position by a return spring (not shown) contained in the cleaning unit 310*d*. Moving the capping component 908 in the xz plane facilitates an improved seal between cap 913 and print cartridge's print head.

The described components of the cleaning unit 310*d* may be molded from polymers and/or other suitable materials as will be recognized by the skilled artisan. By way of example, the springs, such as spring 916 also may be made of steel.

Figure 11:
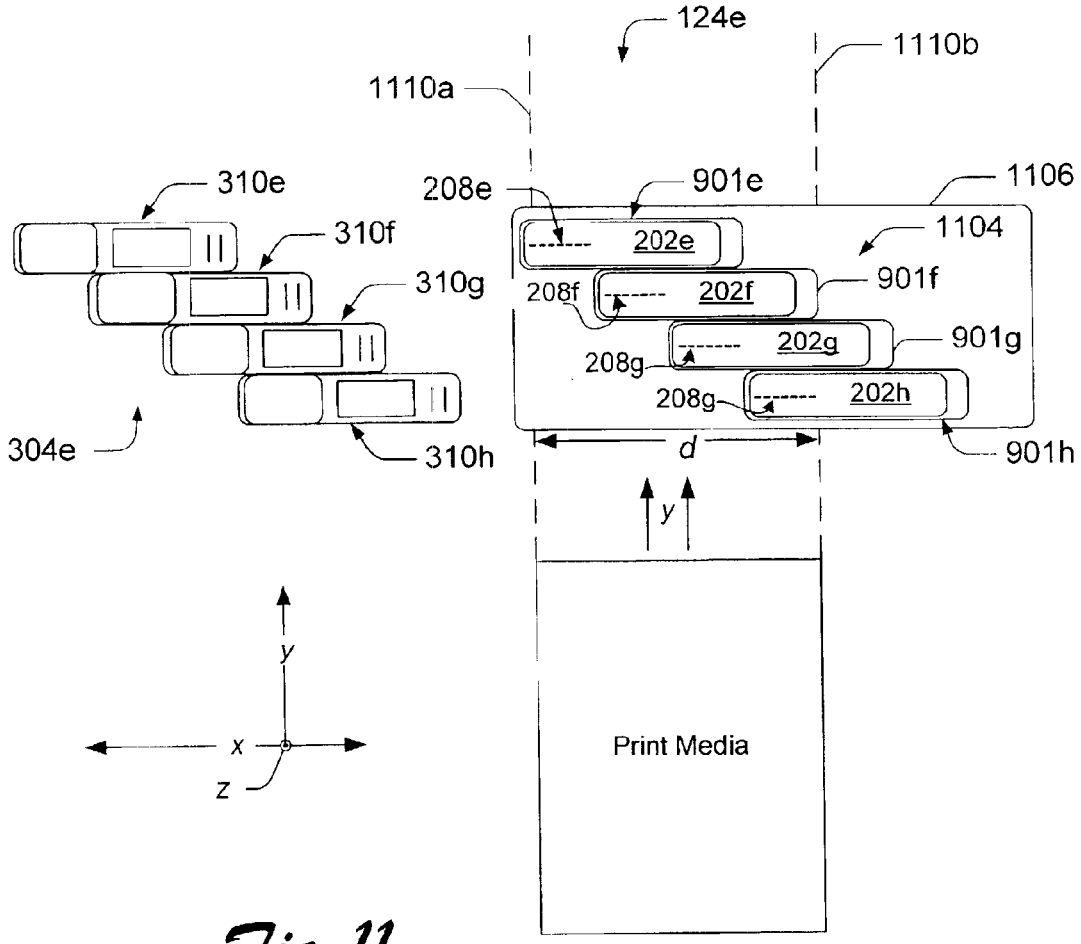
FIGS. 11–12 show top views of portions of an exemplary print unit with components in two interrelated positions in accordance with one embodiment.
Figure 12:
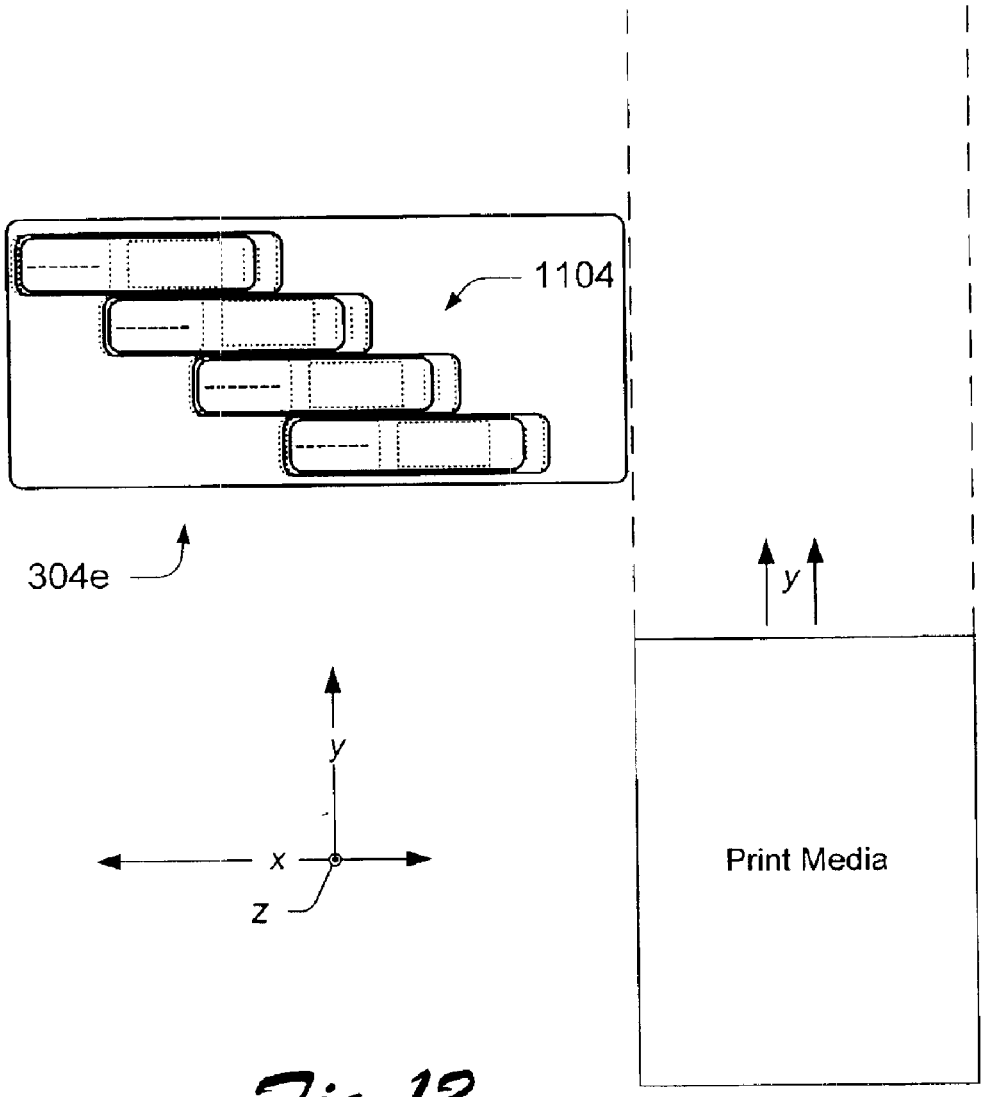

FIGS. 11–12 show an exemplary printing system which, in this embodiment, comprises an exemplary print unit 124*e*. The printing unit includes a plurality of print cartridges 202*e–h*. The print unit further comprises a service station 304*e* comprised of cleaning units 310*e–h*. In this embodiment, four print cartridges are provided, although other embodiments may comprise fewer or more print cartridges. By way of example individual print cartridges 202*e–h* each has a single generally linear nozzle array 208*e–h* respectively.

In some embodiments, individual print cartridges 202*e–h* are positioned relative to one another to form an offset array of print cartridges (hereinafter "array") 1104. The array can comprise a staggered or stair-step configuration. In some embodiments, multiple print cartridges are positioned directly on a base plate 1106, which in some embodiments comprises a carriage. In this embodiment, print cartridges in the form of print cartridge assemblies 901*e–h* are positioned on the base plate 1106.

In this embodiment, the print cartridges 202*e–h* are disposed generally parallel to one another and perpendicular to a media path represented in this embodiment as paper feed axis "y". The nozzle arrays 208*e–h* of the various individual print cartridges 202*e–h* may be staggered with no overlap in the direction of the paper feed axis y or have slight overlap between the nozzle arrays 208*e–h* of adjacent print cartridges 202*e–h*.

In Operation

FIGS. 11–12 show a first example of servicing an array 1104. In this example, the array can be moved by moving base plate 1106.

FIG. 11 shows array 1104 in a first position. In this example, the first position is over a media path which extends between designators 1110*a* and 1110*b*. In this first position, the print cartridges 202*e–h* can be collectively controlled, such as by processor 102, to form a desired image on a print media as it is moved along the media path.

FIG. 12 shows array 1104 moved to a second position. In this example, the second position is outside an area over the media path. The second position is over service station 304*e* which is shown in dashed lines to indicate that it is obscured by array 1104. Moving the array to the second position can allow servicing of the print cartridges comprising the array. In some embodiments, the chance of ink inadvertently falling on the media path can be reduced by moving the print cartridges to a position that is not over the media path during servicing. Further, media is often moved along the media path by means of a conveyor system underlying the media path. Such systems can limit the amount of room available for servicing over the media path.

Figure 13:
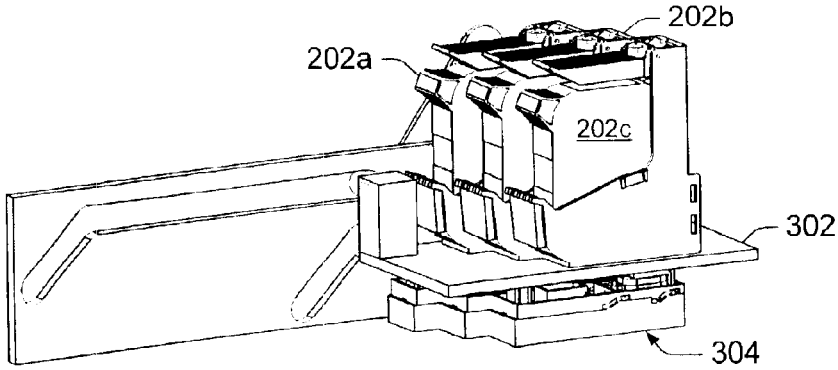
FIGS. 13–14 show perspective views of portions of an exemplary print unit with components in two interrelated positions in accordance with one embodiment.
Figure 14:
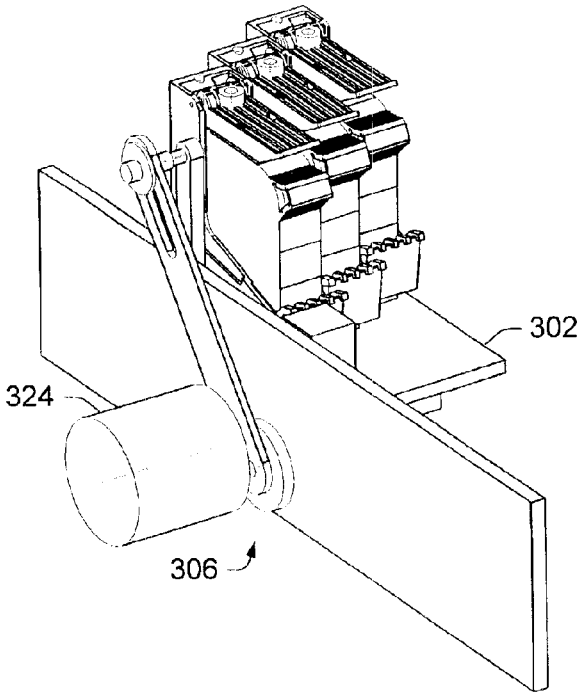

For another example, the reader is referenced back to FIGS. 3 and 4 which show print cartridges 202*a–c* in a first position. This can be contrasted with FIGS. 13 and 14, where print cartridges 202*a–c* are in a second position. Moving the print cartridges to the second position can allow the print cartridges to be serviced by service station 304. In this example, print cartridges 202*a–c* can be serviced simultaneously, though such need not be the case.

As shown in FIGS. 3–4 and 13–14, print cartridges 202*a–c* are moved by motor assembly 306. In this example, the print cartridges are positioned on base plate 302. Also in this example, a single motor 324 provides a locomotive means to move base plate 302 via crank arm 326, and lifter 328. In this example, base plate 302 travels between side plates 322*a*, 322*b* via roller assembly 320*a–d* which rides in tracks 502*a–d*. This configuration moves print cartridges 202*a–c* in a first direction indicated as r and a second different direction indicated as s as indicated in FIG. 8.

In this example, first direction r involves both a horizontal component parallel to the x axis and a vertical component parallel to the z axis shown in FIGS. 9, 11, and 12. As such, movement in first direction r can comprise diagonal movement in some embodiments.

Also in this example, second direction s is oblique to first direction r and involves horizontal movement parallel to the x axis in FIGS. 9, 11, and 12. In this example, such a configuration can allow the print cartridges to be moved upwardly so that the print cartridges are vertically aligned with the service station. It can then allow the print cartridges to be moved along an axis of the service station's cleaning units for servicing.

The example discussed here in relation to FIGS. 3–4 and 13–14 utilizes a motor assembly which can move the print cartridges for servicing relatively quickly. Similarly, the print cartridges can quickly be returned from servicing to begin a new print job. Such a configuration can also be simpler to manufacture and control than systems utilizes multiple motors.

Conclusion

The described embodiments relate to a printing device. The printing device can position an array of print cartridges in a first position over a media path to form a desired image. In some embodiments, the print cartridges can be moved to a second position for servicing. In one such embodiment, the print cartridges can be serviced at a second position that is outside an area over the media path by moving the print cartridges in a first direction and a second different direction.

Although the embodiments have been described in language specific to structural features and/or methodological acts, it is to be understood that the appended claims are not limited to the specific features or acts described.

What is claimed is:

1. A printing device comprising:

one or more print cartridges configured to remain stationary in a first position over a media path during printing and configured to be serviced while in a second position outside an area above the media path;

a service station configured to service the one or more print cartridges; and a motor assembly configured to move the one or more print cartridges from the first position in a first direction and then a second different direction to the second position.

2. The printing device of claim 1, wherein the motor assembly comprises a single motor.

3. The printing device of claim 1, wherein the motor assembly comprises a 4 bar linkage.

4. The printing device of claim 1 further comprising a conveyer means positioned below the media path and configured to move media along the media path.

5. A printing device comprising:

multiple print cartridges for creating a print image, wherein the print cartridges are stationary during printing;

multiple cleaning units configured to service the multiple print cartridges; and a motor assembly for positioning the cleaning units and print cartridges relative to one another for servicing, wherein the motor assembly comprises a single motor, wherein the motor assembly is configured to move the print cartridges along a vector having components from each of two generally orthogonal axes, and where each of said two generally orthogonal axes is orthogonal to a media feed axis.

6. The printing device of claim 5, wherein the motor assembly comprises a four bar linkage.

7. A printing device comprising:

means for creating a desired image by ejecting ink from multiple image forming means positioned in an offset array over a media path; and a single locomotive means for moving at least one of the multiple image forming means and a servicing means relative to the other of the multiple image forming means and the servicing means in a first direction and then a second different direction to service the multiple image forming means at a location not over the media path.

8. One or more computer-readable media having computer-readable instructions thereon which, when executed by a printing device, cause the printing device to:

eject ink from an offset array of print cartridges positioned in a first position over a media path; and service the print cartridges with multiple cleaning units by moving the print cartridges in a first direction and then a second different direction to a second position outside an area above the media path the media path.

9. A printing device comprising:

multiple print cartridges;

a base plate supporting the multiple print cartridges;

a service station comprising one or more cleaning components that can be utilized to clean the multiple print cartridges; and one or more tracks which extend between the base plate and the service station, wherein said one or more tracks movably receive the base plate to accommodate movement of the base plate towards the service station for servicing the multiple print cartridges, wherein the track extends along a first direction along which the base plate can be moved, and a second direction along which the base plate can be moved, the second direction being different from the first direction.

10. The printing device of claim 9, wherein the service station comprises a wiping component, a spitting component, and a capping component.

11. The printing device of claim 9, wherein each print cartridge has an associated service station component, each service station component being oriented along a long axis, and wherein the first direction is generally oblique with respect to the long axes.

12. The printing device of claim 9, wherein each print cartridge has its own service station component, each service station component being oriented along a long axis, and wherein the second direction is generally parallel with respect to the long axes.

13. The printing device of claim 9, wherein each print cartridge has its own service station component, each service station component being oriented along a long axis, and wherein the first direction is generally oblique with respect to the long axes and the second direction is generally parallel with respect to the long axes.

14. A printing device comprising:

multiple print cartridges;

a base plate supporting the multiple print cartridges;

a service station comprising multiple cleaning components that can be utilized to clean the multiple print cartridges, the multiple cleaning components comprising a wiping component, a spitting component, and a capping component;

multiple tracks which extend between the base plate and the service station, the tracks extending along respective first directions along which the base plate can be moved, and respective second directions along which the base plate can be moved, the second directions being different from the first directions; and a roller assembly fixedly connected on the base plate and having individual rollers that ride in the respective tracks, the roller assembly being configured to permit movement of the base plate towards the service station for servicing the multiple print cartridges.

15. The printing device of claim 14, wherein each print cartridge has its own service station component, each service station component being oriented along a long axis, and wherein the first directions are generally oblique with respect to the long axes.

16. The printing device of claim 14, wherein each print cartridge has its own service station component, each service station component being oriented along a long axis, and wherein the second directions are generally parallel with respect to the long axes.

17. The printing device of claim 14, wherein each print cartridge has its own service station component, each service station component being oriented along a long axis, and wherein the first directions are generally oblique with respect to the long axes and the second directions are generally parallel with respect to the long axes.

18. The printing device of claim 14, further comprising a single motor operably connected with the base plate for moving the base plate towards and/or away from the service station.

19. The printing device of claim 14, wherein the roller assembly permits the base plate to be moved to the service station so that all of the print cartridges are serviced simultaneously.

20. A printing device comprising:

a base plate configured to orient multiple print cartridges in an offset array configuration; and a pair of generally opposing side plates configured to guide the base plate between a first position and a second different position to service the multiple print cartridges, wherein the pair of side plates are configured to guide the base plate in a first direction and then a second different direction.

21. The printing device of claim 20, wherein the pair of side plates have tracks formed therein, and further comprising a roller assembly fixed to the base plate and positioned on the tracks.

22. A method comprising:

positioning a plurality of print cartridges over a media path, wherein the print cartridges are positioned to create a collective print swath greater than a print swath that can be achieved by any individual print cartridge; and positioning a service station configured to allow servicing of the plurality of print cartridges, wherein said servicing comprises moving the print cartridges and the service station relative to one another with only a single locomotive means in a first direction and then a second different direction.

23. The method of claim 22, wherein the act of servicing comprises one or more of: wiping, spitting, and capping.

24. The method of claim 22, wherein the act of servicing occurs outside of a region above the media path.

25. A method comprising:

moving an array of print cartridges from a first position over a media path to a second position outside an area above the media path, wherein the moving guides the array of prints cartridges in a first direction and then a second different direction.

26. The method of claim 25, wherein the act of moving is achieved with a single locomotive means.

27. The method of claim 25, wherein the moving engages cleaning units of a service station to service at least one of the print cartridges.

28. The method of claim 25, wherein a service station is positioned outside an area above the media path.

29. The method of claim 25, wherein the array of print cartridges is offset.

* * * * *